United States Patent [19]

Zarley et al.

[11] Patent Number: 4,712,504

[45] Date of Patent: Dec. 15, 1987

[54] TENNIS SCORING MEANS

[76] Inventors: Marilyn J. Zarley; Donald H. Zarley, both of 3709 Southern Hills Dr., Des Moines, Iowa 50321

[21] Appl. No.: 848,760

[22] Filed: Apr. 7, 1986

[51] Int. Cl.[4] ..... A63B 49/00; G09F 9/40

[52] U.S. Cl. ..... 116/222; 116/323

[58] Field of Search ..... 116/222, 225, 235, 240, 116/306, 307, 321–324, 236, 237; 273/73 R, DIG. 26; 235/1 B; 40/5, 352, 488, 491

[56] References Cited

U.S. PATENT DOCUMENTS

| | | | |
|---|---|---|---|
| 381,425 | 4/1888 | Rosenwasser et al. | 116/225 |
| 448,878 | 3/1891 | Clarke | 273/73 R |
| 1,501,233 | 7/1924 | Rand | 116/324 |
| 2,585,421 | 2/1952 | Armand neé Dumais | 116/240 |
| 4,158,342 | 6/1979 | Scruggs | 116/225 |
| 4,331,098 | 5/1982 | Rubano | 116/225 |
| 4,498,668 | 2/1985 | Bowen | 273/73 R |

*Primary Examiner*—Charles Frankfort

*Assistant Examiner*—W. Morris Worth

*Attorney, Agent, or Firm*—Zarley, McKee, Thomte, Voorhees & Sease

[57] ABSTRACT

A tennis scoring device is disclosed comprising an elongated body member having a longitudinal axis, with a visible tennis scoring indicia secured on the top surface of the body member and extending along the longitudinal axis thereof. The indicia strip is divided into a plurality of duplicate scoring segments representing the scores of the player and the opponent. A pair of slide members are resiliently slidably mounted on the edges of the body member and extend over the indicia strip. An aperture in each of the slide members provides visible access to a given indicia segment. The width of the body member is greater than the normal width of the slide members so that the slide members are slightly expanded upon being mounted on the body member to resiliently hold the slide members in position on the body member.

10 Claims, 5 Drawing Figures

TENNIS SCORING MEANS

BACKGROUND OF THE INVENTION

Tennis is a game of concentration, but particularly in recreational and club tennis, the concentration is often on the execution of the game, and not on the scoring. As a result, questions often arise in both doubles and singles matches as to the accuracy of the score in a given game.

Many tennis scoring devices have been used over the years by the tennis players. Some are subject to malfunction as the game is in process; others are either difficult or timeconsuming to operate; and others interfere with the tennis game or serve to distract the player's attention.

It is, therefore, a principal object of this invention to provide a tennis scoring device which can be easily and quickly manipulated.

A further object of this invention is to provide a tennis scoring device which can be secured to the player's racquet, but which will not malfunction when the ball hits the racquet, and which will not interfer in any way with the use of the racquet.

These and other objects will be apparent to those skilled in the art.

BRIEF SUMMARY OF THE INVENTION

The tennis scoring device of this invention includes an elongated body member which is normally secured to the outer curved side edge of the racquet. A visible tennis scoring indicia strip is secured in a longitudinal direction on the center of the body member, and is divided into a plurality of duplicate scoring segments representing the scores of the player and the opponent. A pair of slide members are resiliently slidably mounted on the edges of the body member and span the indicia strip. An aperture in each of the slide members provides visible access to a given segment over which the slide members span. The slide members are moved to the appropriate position over the indicia strip corresponding to the score of the respective players or teams. The width of the body members is greater than the normal width of the slide member so that the slide members are slightly expanded upon being mounted on the body member. The resulting friction releasably holds the slide members in a fixed position during play, and can be moved to a successive position manually as the game progresses.

DETAILED DESCRIPTION OF THE PREFERRED EMBODIMENT

Figure 1:
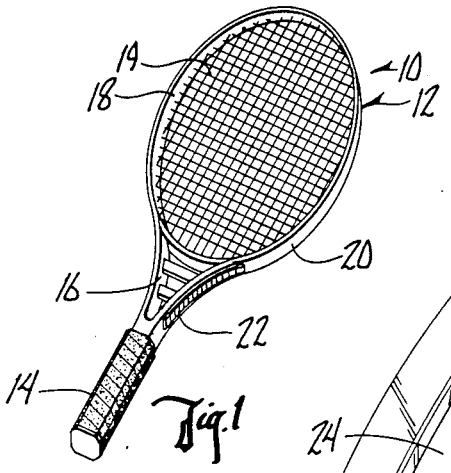
FIG. 1 is a perspective view of a conventional tennis racquet with the scoring device of this invention attached thereto.
Figure 2:
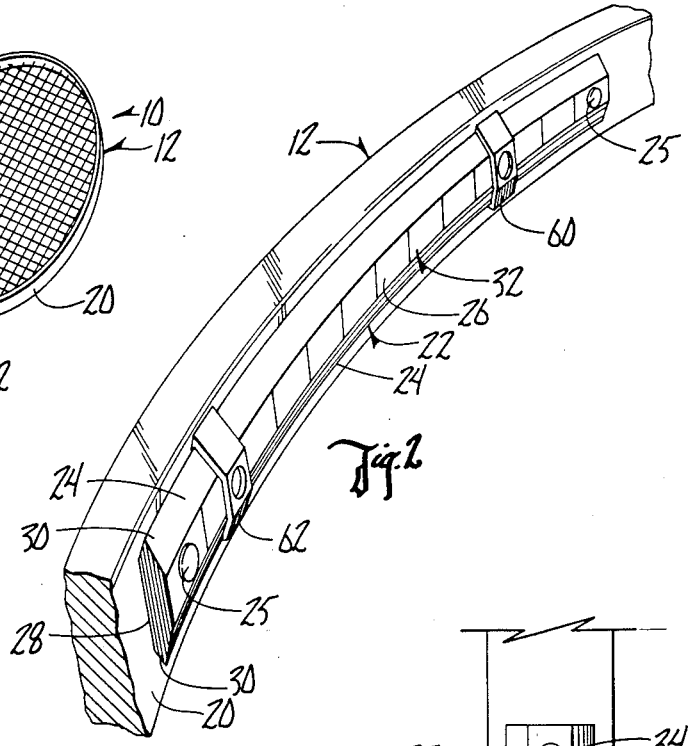
FIG. 2 is a perspective view of the scoring device of this invention shown at an enlarged scale and mounted on a segment of the racquet shown in FIG. 1.
Figure 3:
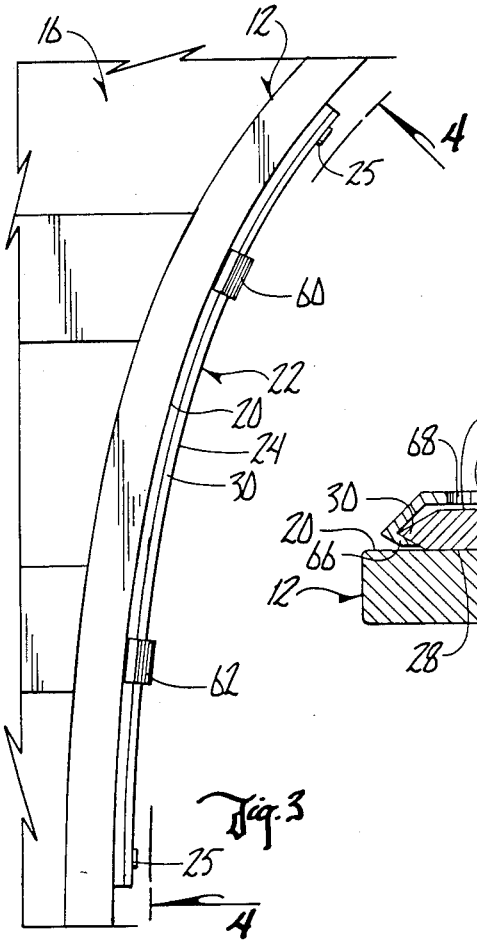
FIG. 3 is a plan view of a portion of the racquet of FIG. 1 shown at an enlarged scale and depicts the scoring device of this invention attached thereto.

The numeral 10 depicts a conventional tennis racquet comprised of a frame 12, a handle 14, a yoke or throat

16, and an oval-shaped, open frame segment 18. Conventional strings 19 are supported by the frame segment 18. Frame 12 has an outer side edge 20.

Numeral 22 represents the scoring device of this invention. An elongated body member 24 is comprised of plastic or the like and is secured by rivets 25 or the like to the outer side edge 20 of frame 12. Body member 24 is normally 5 or 6 inches long and $\frac{1}{2}$ to $\frac{3}{8}$ of an inch wide. Its thickness can vary, but is normally in the order of $\frac{1}{8}$ of an inch. Body member 24 can have some resiliency so as to be bent to conform to the curved configuration of the outer edge 20 of frame 12.

The body member 24 includes a flat top 26, a flat bottom 28, and tapered side edges 30.

Figure 4:
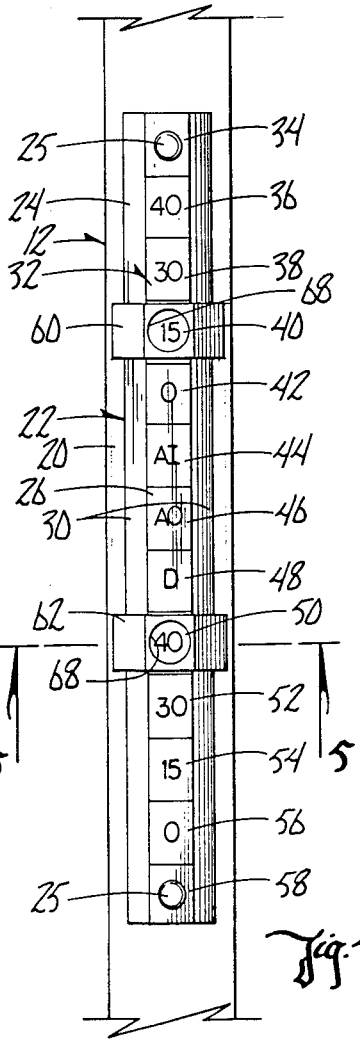
FIG. 4 is a plan view of the scoring device of this invention as seen on line 4—4 of FIG. 3.

An indicia strip 32 is glued or otherwise secured to the flat top 26 of body member 24. Indicia strip 32 is divided into a plurality of indicia segments 34, 36, 38, 40, 42, 44, 46, 48, 50, 52, 54, 56 and 58 as best shown in FIG. 4. As will be discussed hereafter, segments 34 and 58 are "neutral" segments. Segments 42, 40, 38, and 36 represent the "0", "15", "30", and "40", scores of the scorer. Segments 56, 54, 52, and 50 represent the "0", "15", "30", and "40" scores of the scorer's opponent. Segment 48 represents a "deuce" score; segment 46 represents the "add-out" score, and segment 44 represents the "add-in" score.

Figure 5:
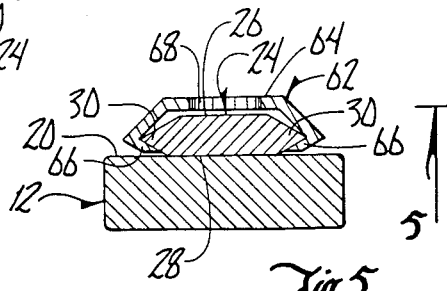
FIG. 5 is a sectional view of the invention taken on line 5—5 of FIG. 4.

U-shaped slides 60 and 62 slidably embrace the side edges 30 of body member 24 as best shown in FIG. 5. Each of the slide members 60 and 62 include a flat top 64, opposite side tabs 66 which extend around and under the side edges 30 of body member 24, and aperture 68 in the top 64 to provide visual access to each of the scoring segments 34–58. As seen in FIG. 5, the tabs 66 do not touch the outer side edge 20 of frame 12.

The normal width of the slide members 60 and 62 is less than the lateral width of body member 24 so that when the slide members are placed on the body member, they are laterally extended to exert spring tension against side edges 30 of the body member. This phenomenon enables the slide members to stay in position on the body member until they are manually moved to the next successive position.

The normal operation of the device of this invention is as follows: The scorer should move the slide 60 to segment 42 and should move slide 62 to segment 56 as the game commences. As each point is won or lost by the scorer, the appropriate slide member 60 or 62 is advanced to reflect the score of the scorer or his oponents. For example, if the scorer won the first point, the slide member 60 would be moved from segment 42 to segment 40 as shown in FIG. 4. If the scorer's opponent won the next three points, the slide 62 would be moved first from segment 56 to segment 54, thence from segment 54 to segment 52, and thence to segment 50.

In the event that both players have a score of "40" one slide member can be moved to the neutral segments 34 or 58, and the other slide member is moved to the "duece" segment 48. The remainder of the game is then scored with one slide member. If the scorer loses the first point thereafter, the slide member is moved to segment 46 which is the "add-out" segment. If the scorer then wins the next point, the slide member is turned to the "duece" segment 48. If the scorer then wins the next point, the slide member is moved to the "add-in" segment 44. This is continued until one of the players wins two points in a row after a duece score to win the game.

The slide members 60 and 62 are preferably comprised of polypropylene and they easily slide on the body member 24 without any abrasive or sound effect. The scoring can be done instantly, usually by the left-hand thumb of a right-hand player who merely moves one of the slide elements from one segment to an immediate adjacent segment. This can be done in a split-second and does not divert the player's attention or distract from the game. The use of this device has the added benefit of causing the scorer to give more conscious attention to the score of the game.

When a game is concluded, the slide members 60 and 62 are returned to the "0" or "love" positions 42 and 56, respectively, and the scoring process is then repeated for the next successive game.

The scoring device 22 is preferably attached to a tennis racquet, but is useful if merely carried by the scorer, or attached to an article of clothing. Obviously, scoring device 22 can also be used by a spectator.

Any desired means can be used to secure the scoring device 22 to the racquet frame 12. The scoring device is shown in the preferred position in FIG. 1 because it creates less wind resistance as the player strokes the ball. A second scoring device having scoring indicia reflecting the game scores could be secured to frame 23 on the side of yoke 16 opposite to the position of scoring device 22.

It is seen from the foregoing, that this invention achieves at least all of its stated objectives.

We claim:

1. The combination of a tennis racquet having a frame comprising an elongated handle terminating in an open oval-shaped frame segment, and a tennis scoring device comprising, an elongated body member having a longitudinal axis, and a top, a bottom and opposite side edges, said bottom being secured to said frame and said side edges being free from contact with said frame along their entire length, visible tennis scoring indicia means secured to said body member and extending in a direction parallel to said axis, said indicia means divided into a plurality of indicia segments, and at least one slide member movably slidably mounted on said body member and adapted for movement in a direction parallel to said axis, and being adapted to be positioned adjacent different of said indicia segments, whereby the scorer cans move the slide member to a position adjacent the indicia segment that properly reflects the tennis score being kept, said slide member comprising a resilient U-shaped member having a top that extends over the top of said body member, and depending tabs that slidably engage said side edges of said body member, said body member having a width greater than the normal width of said slide member so that said tabs are resiliently forced apart by the side edges of said body member whereby said tabs are laterally extended to exert spring tension against said side edges of said body member to create sufficient friction therebetween to releasably hold said slide member in a fixed position on said body member when a tennis ball hits the racquet as the tennis game is being palyed, while also permitting the slide member to be easily and quickly slidably moved on said body member to change the tennis socre being kept.

2. The combination of claim 1 wherein said indicia means includes duplicate scoring segments for two tennis scores, and two slide members are slidably mounted on said body member.

3. The combination of claim 1 wherein said indicia segments include "0", "15", "30", "40", "add-in", "add-out", and "deuce".

4. The combination of claim 1 wherein an aperture is located in said slide member, and said slide member extends over said indicia means, whereby an indicia segment can be visually seen through said aperture.

5. The combination of claim 2 wherein said indicia segments include "0", "15", "30", "40", "add-in", "add-out", and "deuce".

6. The combination of claim 2 wherein an aperture is located in said slide member, and said slide member extends over said indicia means, whereby an indicia segment can be visually seen through said aperture.

7. The combination of claim 1 wherein said frame segment has an arcuate outer edge and said body member is secured to said frame beyond said handle and is disposed in an arcuate position parallel to said arcuate outer edge.

8. The combination of claim 1 wherein said tabs are spaced from engagement with said frame.

9. The combination of claim 1 wherein said body member and said slide member are comprised of plastic material.

10. The combination of claim 2 wherein said body member and said slide members are comprised of plastic material.

* * * * *